US006896540B1

(12) United States Patent
Wu

(10) Patent No.: US 6,896,540 B1
(45) Date of Patent: May 24, 2005

(54) CABLE END CONNECTOR ASSEMBLY HAVING LOCKING MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/797,979

(22) Filed: Mar. 10, 2004

(51) Int. Cl.[7] ..... H01R 4/24
(52) U.S. Cl. ..... 439/417; 439/353
(58) Field of Search ..... 439/417, 350, 439/353, 354, 357, 358, 352

(56) References Cited

U.S. PATENT DOCUMENTS 6,273,745 B1 * 8/2001 Yeh ..... 439/404
6,454,577 B1 * 9/2002 Yi ..... 439/108
6,565,383 B1 5/2003 Wu
6,585,536 B1 * 7/2003 Wu ..... 439/358
6,585,537 B1 7/2003 Lee
6,645,002 B1 * 11/2003 Lee ..... 439/497
6,655,979 B1 12/2003 Lee
6,666,706 B1 * 12/2003 Jones et al. ..... 439/405
6,716,056 B1 * 4/2004 Hsu ..... 439/417
6,773,293 B1 * 8/2004 Lee ..... 439/357
6,776,646 B2 * 8/2004 Lee ..... 439/357
6,821,139 B1 * 11/2004 Wu ..... 439/352

* cited by examiner

*Primary Examiner*—Ross Gushi
(74) *Attorney, Agent, or Firm*—Wei Te Chung

(57) ABSTRACT

A cable end connector assembly (1) includes an insulative housing (2) including a front engaging portion (20) and a rear terminating portion (22), a number of IDC contacts (3) received in the insulative housing, a number of wires (4) electrically connecting with corresponding contacts, a cover (5) mechanically mounted to the terminating portion of the insulative housing, and a locking member (6). The cover defines a pair of passages (526). The locking member includes a retaining portion (60) secured with the engaging portion of the insulative housing, a pressing portion (62) received in the passages of the cover, a pressing portion (63) engaged with the cover and a pair of latch sections (610) located close to the retaining portion. The pressing portion moves downwardly toward the cover under a pressing force and creates a vertical displacement to the latch sections.

20 Claims, 15 Drawing Sheets

CABLE END CONNECTOR ASSEMBLY HAVING LOCKING MEMBER

CROSS-REFERENCE TO RELATED APPLICATIONS

This application is related to U.S. patent application Ser. No. 10/397,446 filed on Mar. 25, 2003, invented by George Lee, entitled "CABLE CONNECTOR ASSEMBLY WITH LATCHING MEANS", and Ser. No. 10/776,111 filed on Feb. 10, 2004, invented by Jerry Wu, entitled "CABLE END CONNECTOR ASSEMBLY HAVING LOCKING MEMBER", both of which are assigned to the same assignee as this application.

BACKGROUND OF THE INVENTION

1. Field of the Invention

The present invention relates to a cable end connector assembly, and particularly to a cable end connector assembly having a locking member for locking with a complementary connector.

2. Description of Related Art

There exists in the art an electrical connector known as a Serial Advanced Technology Attachment (Serial ATA) connector which is generally used for disk drives and storage peripherals. Especially, the Serial ATA connectors according to the Serial ATA standard are featured in fewer electrical contacts than other conventional electrical connectors and are relatively tiny in configuration. It is desirable for the Serial ATA connector to have latch means for providing a reliable mechanical and electrical connection with a complementary connector. U.S. Pat. Nos. 6,565,383 and 6,585,536, having the same inventor and the same assignee with the present invention, each disclose a Serial ATA connector equipped with a locking member for locking with a complementary connector. The locking member comprises a middle portion retained on a connector housing, a pushing portion extending rearwardly from the middle portion, and a locking portion extending forwardly from the middle portion for locking/releasing the Serial ATA connector with/from the complementary connector.

However, the locking member is a cantilevered type structure, the vertical distance between a locking position and a releasing position of the locking portion is relatively small, thereby adversely affecting the engagement and disengagement between the Serial ATA connector and the complementary connector.

Hence, a cable end connector assembly having an improved locking member is desired.

SUMMARY OF THE INVENTION

An object of the present invention is to provide a cable end connector assembly having an improved locking member having relatively big displacement for locking/unlocking the cable end connector assembly with/from a complementary connector more conveniently.

To achieve the above object, a cable end connector assembly in accordance with the present invention comprises an insulative housing including a front engaging portion and a rear terminating portion, a plurality of IDC contacts received in the terminating portion of the insulative housing, a plurality of wires electrically connecting with corresponding contacts, a cover mechanically mounted to the terminating portion of the insulative housing, and a locking member. The housing forms a plurality of hook portions adjacent to the terminating portion thereof, and the cover forms a plurality of latching arms extending from a front surface thereof to respectively latch with the hook portions of the housing. The cover defines a pair of passages. The locking member comprises at a front end thereof a retaining portion secured with the engaging portion of the insulative housing, a supporting portion at a rear end thereof engaged with the cover, a pressing portion located on the rear end thereof close to the supporting portion and respectively received in the passages of the cover, and a locking portion extending rearwardly from the retaining portion. The locking portion comprises a pair of latch sections located close to the retaining portion for locking with the complementary connector. The pressing portion is movable downwardly and becomes curve toward the cover under a pressing force and creates a vertical displacement to the locking portion.

Other objects, advantages and novel features of the invention will become more apparent from the following detailed description when taken in conjunction with the accompanying drawings.

DETAILED DESCRIPTION OF THE INVENTION

Figure 1:
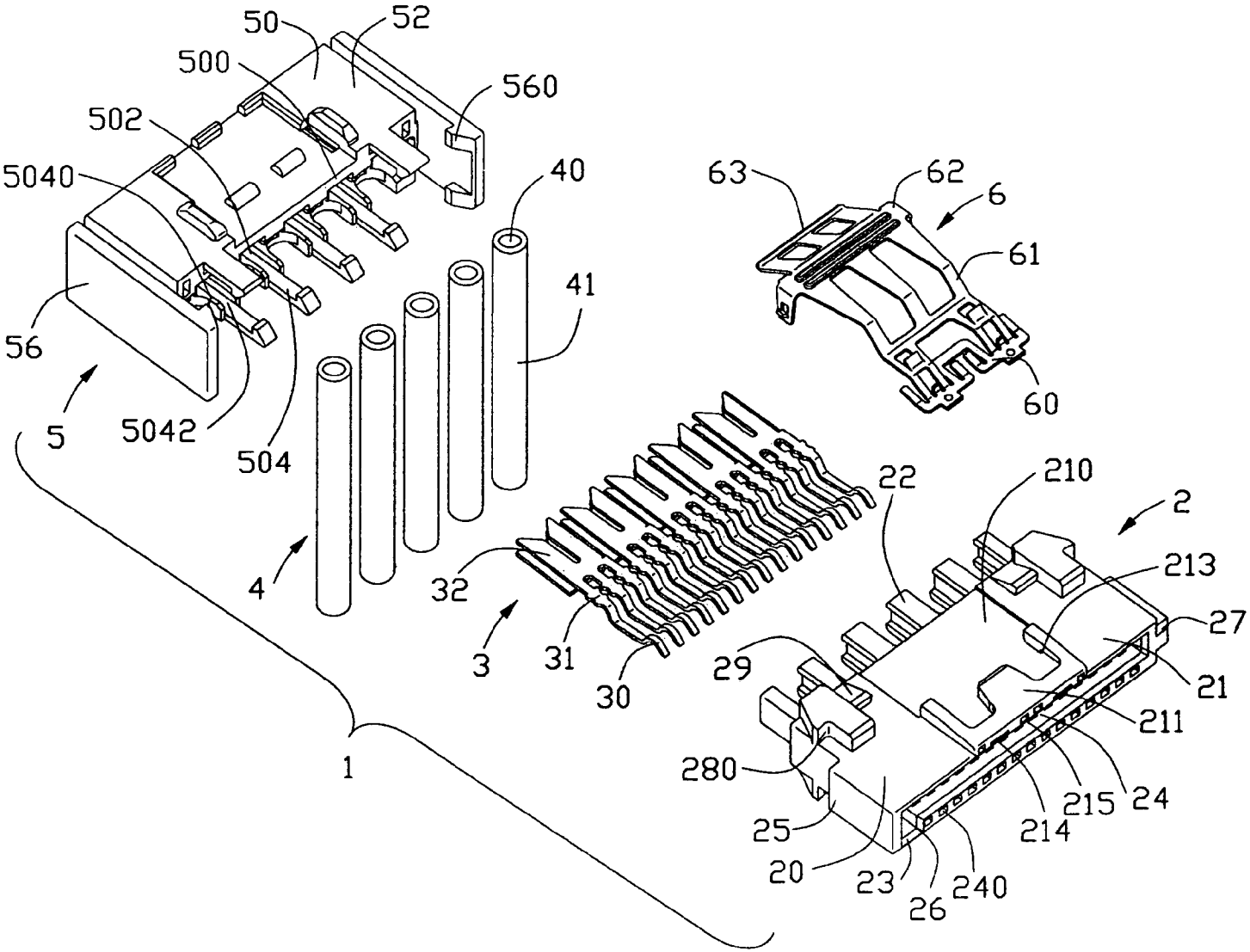
FIG. 1 is an exploded, perspective view of a cable end connector assembly in accordance with the present invention.
Figure 2:
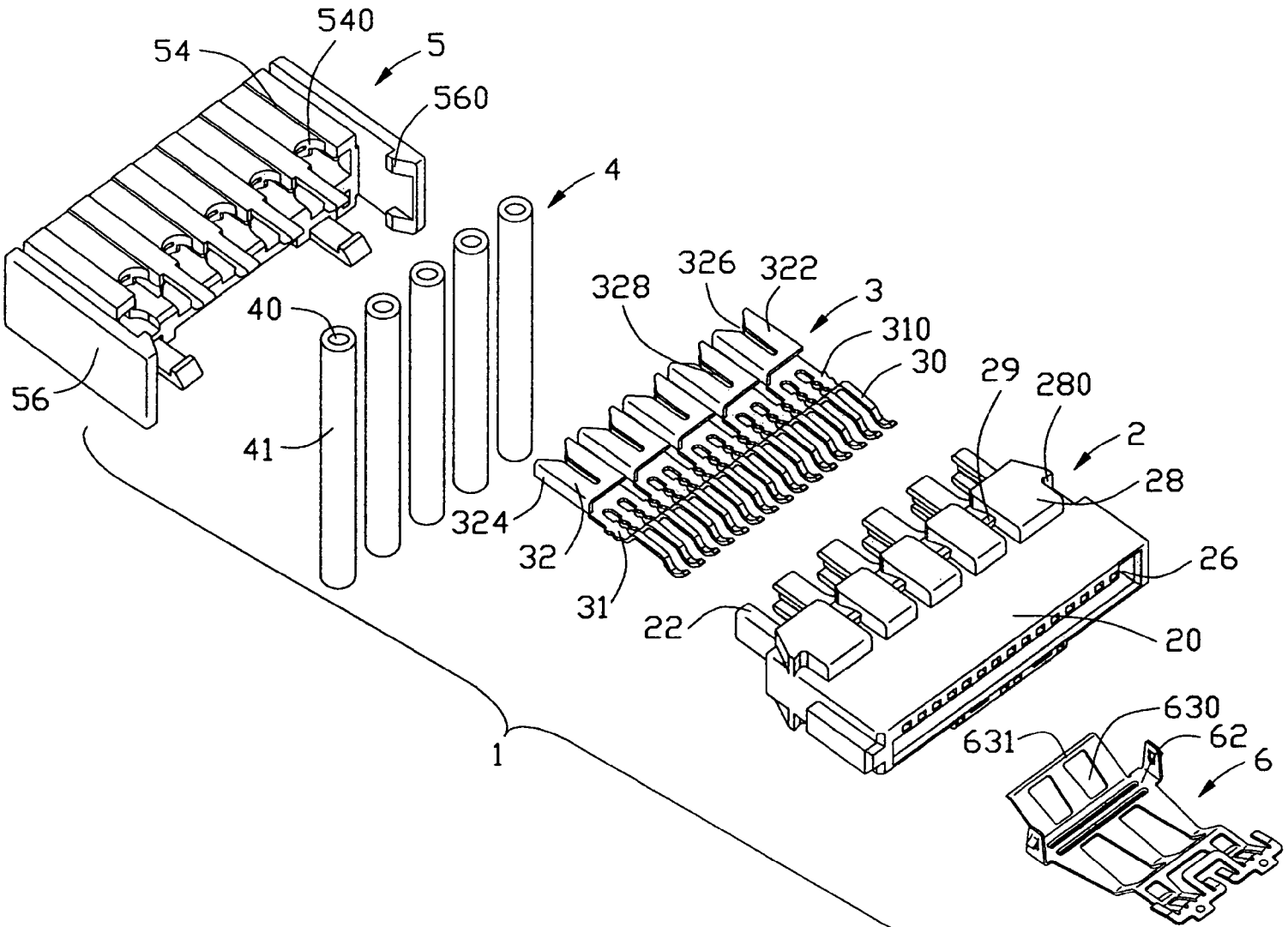
FIGS. 2–4 are views similar to FIG. 1, but taken from different aspects.

Referring to FIGS. 1–4, a cable end connector assembly 1 in accordance with the present invention comprises an insulative housing 2, a plurality of contacts 3, a plurality of wires 4, an insulative cover 5 and a locking member 6.

Referring to FIGS. 1–4 in conjunction with FIGS. 9–15, the insulative housing 2 comprises a front engaging portion 20 and a rear terminating portion 22. The front engaging portion 20 comprises an upper wall 21, a lower wall 23 opposite to the upper wall 21, and a pair of sidewalls 25 connecting with the upper wall 21 and the lower wall 23. A guiding projection 27 projects outwardly from one sidewall 25 for guiding a proper insertion of a complementary connector. An L-shaped receiving space 26 is defined between the upper and the lower walls 21, 23. A block 24 is formed on the lower wall 23 and protrudes into the receiving space 26. The block 24 defines a plurality of passageways 240. The upper wall 21 defines a depression 210 on an upper surface thereof. A flat portion 211 extends rearwardly from a middle portion of a front flange of the upper wall 21 into the depression 210. A slit 212 (FIG. 9) is formed between the flat portion 211 and a bottom surface of the depression 210. The upper wall 21 defines a pair of grooves 213 extending along opposite inner sides of the depression 126. A pair of first slots 214 and a pair of second slots 215 extend rearwardly from a front face of the upper wall 21 into the flat portion 211 and communicate with the slit 212, respectively. A plurality of protrusions 28 and hook portions 29 are alternatively formed at opposite sides of the upper wall 21 and on the lower wall 23 adjacent to the rear edge of the engaging portion 20. The outmost protrusions 28 each form a claw 280 extending outwardly therefrom.

The rear terminating portion 22 has a plurality of rearwardly projecting posts 220 and every two neighboring posts 220 together define a U-shaped contact-receiving tunnel 222. Each post 220 defines a pair of channels 224 respectively communicating with neighboring contact-receiving tunnels 222. The channel 224 is formed by a pair of opposite walls 226 and a side surface 228.

Each contact 3 has a fork-shaped configuration and comprises a three-beam mating portion 30, a three-beam retention portion 31 extending rearwardly from the mating portion 30, and an insulation displacement portion 32 extending rearwardly form the retention portion 31 for electrically connecting with a corresponding wire 4. Each beam of the retention portion 31 has a plurality of barbs 310 on opposite sides thereof. The insulation displacement portion 32 comprises a first and a second walls 320, 322 and an intermediate section 324 connecting the first and the second walls 320, 322. The first wall 320 extends rearwardly from the retention portion 31. Each wall 320, 322 defines an elongated slot 326 therein. The walls 320, 311 are oppositely configured such that the slots 326 are aligned with each other, whereby the wire 4 can be inserted into the slots 326 in both walls 320, 322 and remains substantially straight. Each wall 320, 322 has a pair of opposite inwardly inclined edges 328 at a rear end thereof, thereby forming an entry 321 communicating with the slot 326.

Each wire 4 comprises a conductor 40 and an outer insulator 41.

The insulative cover 5 comprises a body 50 having opposite top and bottom walls 52, 54 and a pair of lateral walls 56 partially extending forwardly beyond a front surface 500 of the body 50. A plurality of latching arms 504 respectively extend forwardly from the top and the bottom walls 52, 54 and beyond the front surface 500 corresponding to the hook portions 29 of the insulative housing 2. Each lateral wall 56 forms a pair of latches 560 at a distal end thereof. The body 50 defines a plurality of receiving cavities 502 recessing rearwardly from the front surface 500 thereof. The bottom wall 54 is partially cutoff to form a plurality of wire-receiving concaves 540 disposed between every two neighboring latching arms 504. Each latching arm 504 extending from the bottom wall 54 comprises a pair of vertical walls 5040 extending upwardly from opposite edges thereof, whereby a cavity 5042 communicating with a corresponding receiving cavity 502 is circumscribed by the vertical walls 5040 and an inner side of the latching arm 504. The top wall 52 defines a cutout 520 in middle thereof. A pair of passages 526 extending in an up-to-down direction of the cover 5 from a bottom surface of the cutout 520. A pair of tubers 528 are formed on the top wall 52 respectively beside corresponding passages 526. A space 5280 (FIG. 11) is defined below the tuber 528 to communicate with a corresponding passage 526. A pair of pivot portions 522 are formed between the pair of tubers 528 and a plurality of ribs 524 are formed on a rear edge of the cutout 520.

Figure 3:
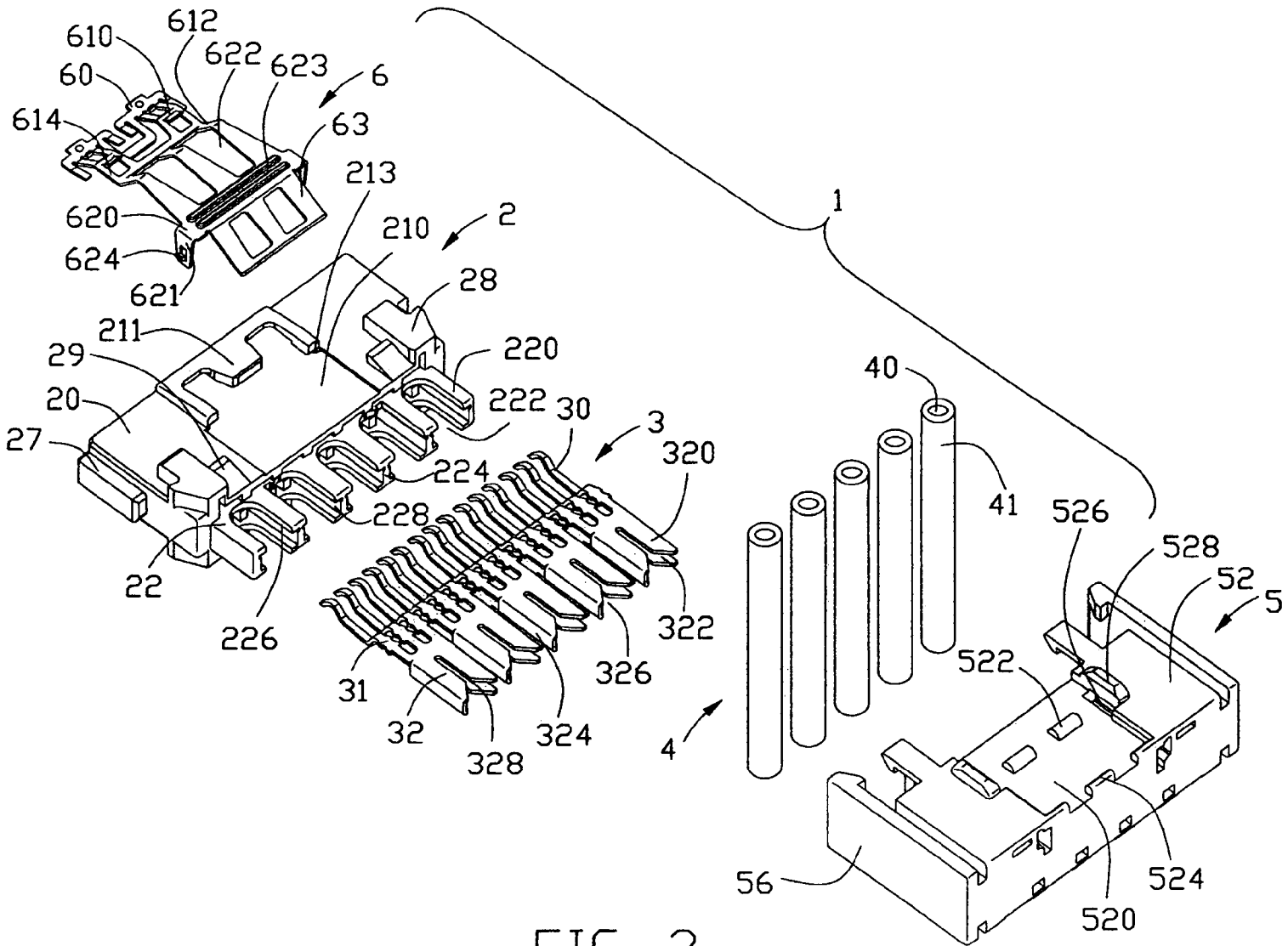
Figure 4:
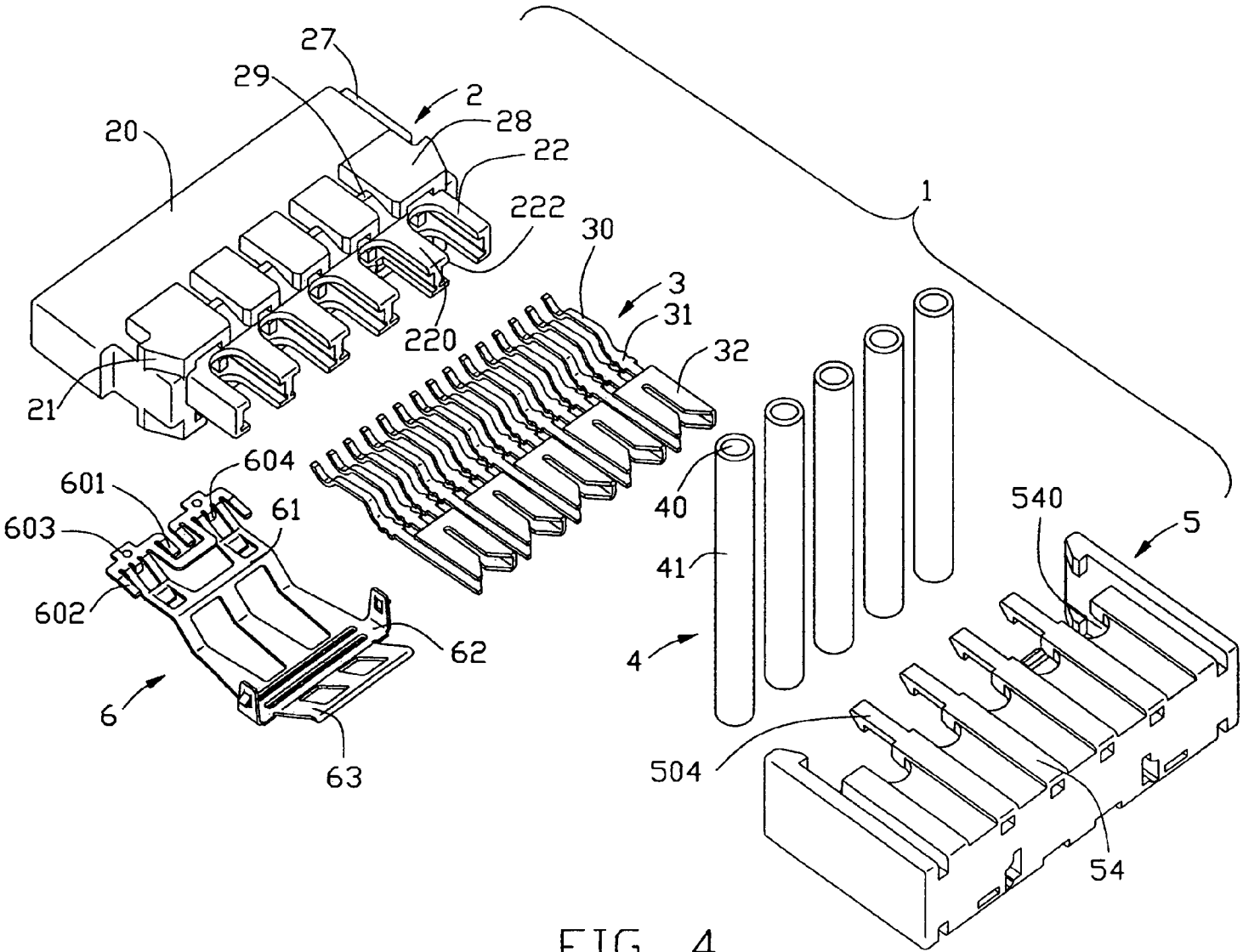

Particularly referring to FIG. 3, the locking member 6 is stamped and formed from a metallic plate and comprises a retaining portion 60, a locking portion 61 extending upwardly and rearwardly from the retaining portion 60, a flat pressing portion 62 extending rearwardly from the locking portion 61, and a supporting portion 63 extending rearwardly and downwardly from the pressing portion 62. The retaining portion 60 has a pair of bar sections 602 extending rearwardly from opposite ends thereof, a pair of snap sections 601 extending upwardly and rearwardly from a middle portion of a front end thereof, a pair of positioning sections 603 extending forwardly from the front end thereof and a pair of curved sections 604 extending opposite to the positioning sections 603. The locking portion 61 is substantially L-shaped and comprises a first section 614 extending rearwardly from the retaining portion 60 and a second section 612 extending rearwardly and upwardly from the first section 614. The first section 614 is formed with a pair of latch sections 610 extending upwardly and rearwardly from a front portion thereof. The pressing portion 62 comprises a body section 620 and a pair of side beams 621 at rear portion thereof and extending downwardly from opposite lateral ends of the body section 620. Each side beam 621 is stamped with a spring tab 624 extending outwardly therefrom. The body section 620 is formed with a plurality of ribs 623 at the rear portion for facilitating handling. A pair of first openings 622 is defined in a front portion of the body section 620 of the pressing portion 62 and the second section 614 of the locking portion 61. The supporting portion 63 also defines a pair of second openings 630 and forms a curved edge 631 at a free end thereof. The first and the second openings 622, 630 are defined for perfect deformation of the locking portion 61 and the supporting portion 63.

Referring to FIGS. 5–8 in conjunction with FIGS. 9–15, in assembly, the contacts 3 are inserted into the dielectric housing 2 in a rear-to-front direction. The mating portions 30 of the contacts 3 are respectively received in front portions of the passageways 240 and are partially exposed in the receiving space 26 for electrically connecting with the complementary connector. The retention portions 31 of the contacts 3 are respectively received in rear portions of the passageways 240 and the barbs 310 of each beam of the retention portion 31 engage with opposite side surfaces of a corresponding passageway 240 for retaining the contacts 3 in the housing 2. The first and the second walls 320, 322 of the insulation displacement portion 32 are received in the pair of opposite channels 224 and corresponding contact-receiving tunnel 26 with the intermediate section 324 abutting against the side surface 228 of the channel 224.

The wires 4 are respectively urged into the insulation displacement portions 32 of the contacts 3. As the wire 4 is positioned in the entry 326, the inwardly inclined edges 323 align the wire 4 with the dual slots 328. Then the wire 4 is urged into the slots 328 with the outer insulator 41 cut by inner edges of the slots 328, thereby the insulation displacement portion 32 connects with the conductor 40 and an electrical connection between the contact 3 and the wire 4 is established.

The insulative cover 5 is then assembled to the insulative housing 2. The posts 220 of the insulative housing 2 are respectively received in the receiving cavities 502 of the cover 5. The latching arms 504 respectively slide along inclined surfaces of the hook portions 29 and then snap onto the hook portions 29. The latching arms 504 are positioned by neighboring protrusions 28, thereby the latching arms 504 have no possibility of moving along a right-to-left direction. The latches 560 of the lateral walls 56 engage with the claws 280 of the outmost protrusions 28 for enhancing the engagement between the cover 5 and the insulative housing 2. The wires 4 are respectively received in the wire-receiving holes 540 to electrically connect with the insulation displacement portions 32 of the contacts 3 more reliably.

Figure 5:
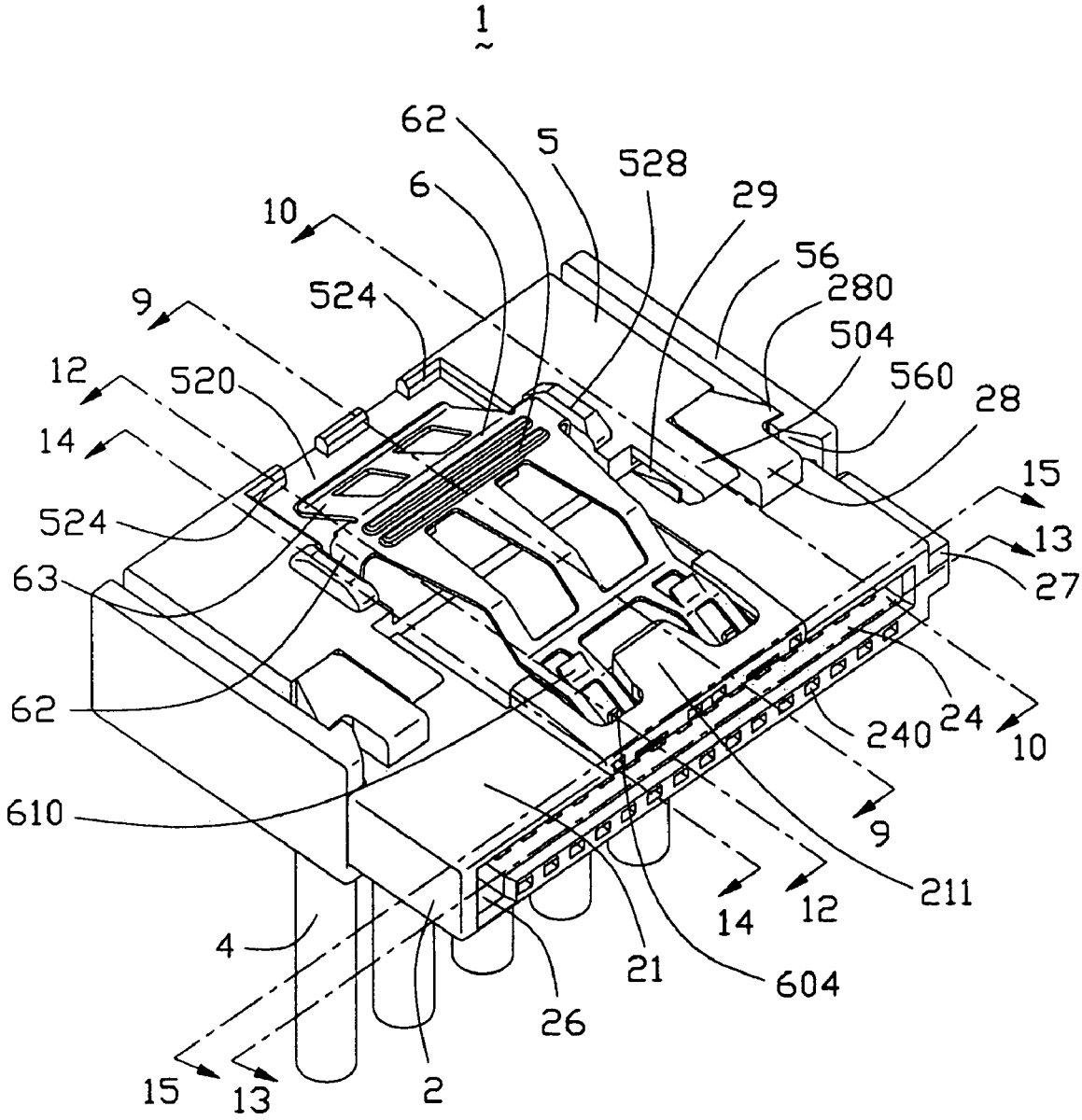
FIG. 5 is an assembled view of the cable end connector assembly of FIG 1.
Figure 6:
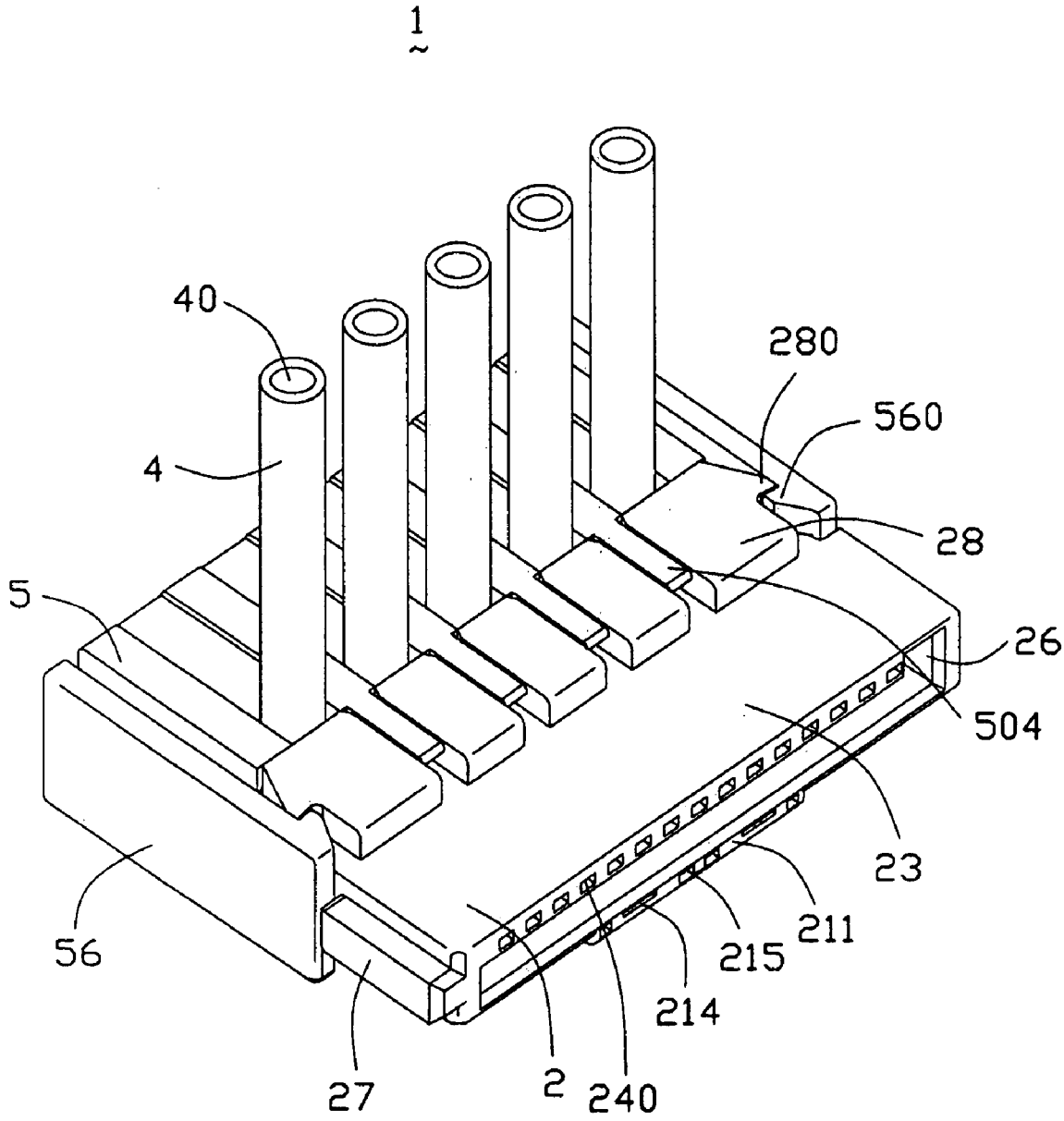
FIGS. 6–8 are views similar to FIG. 5, but taken from different aspects.
Figure 7:
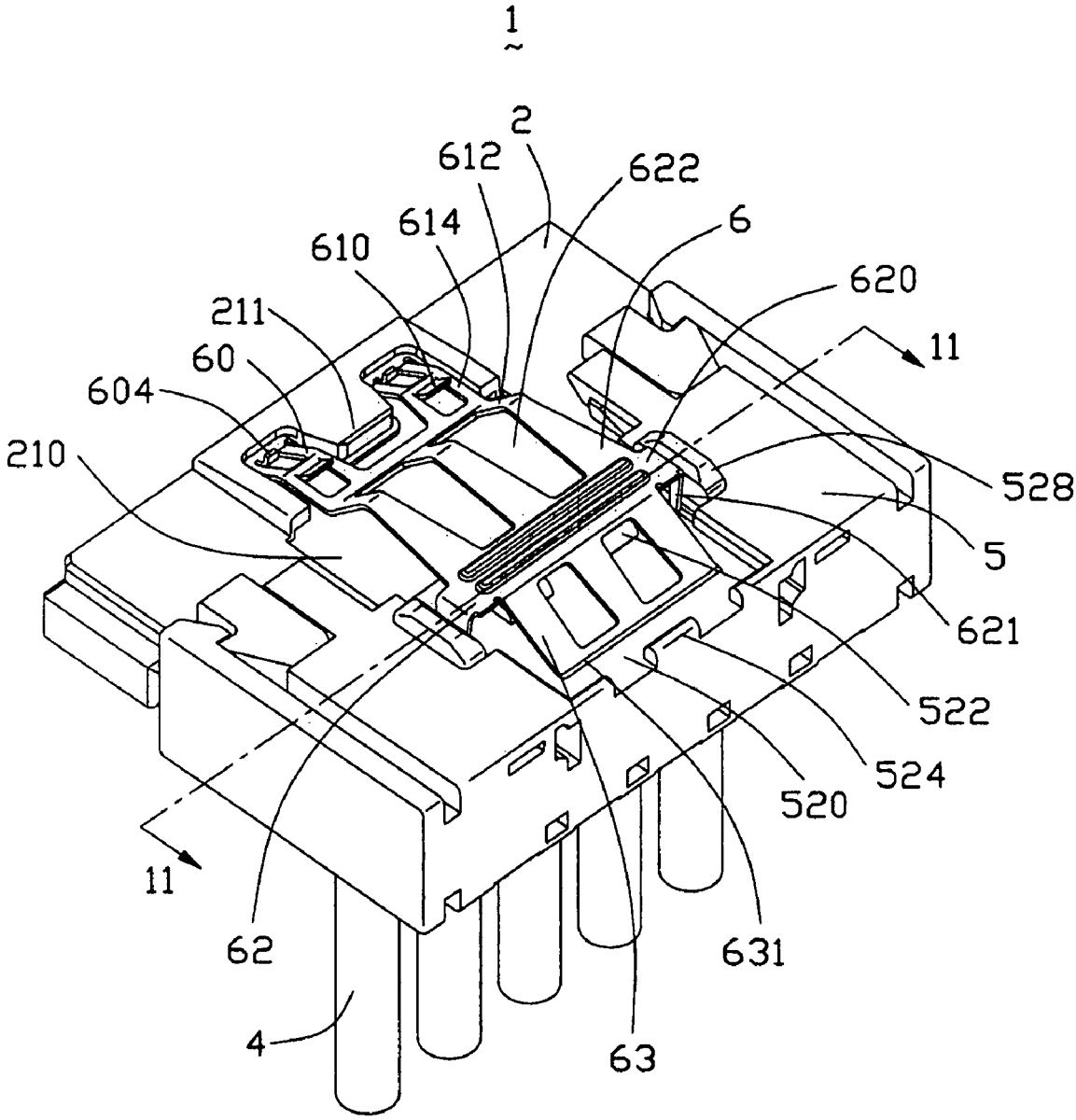
Figure 8:
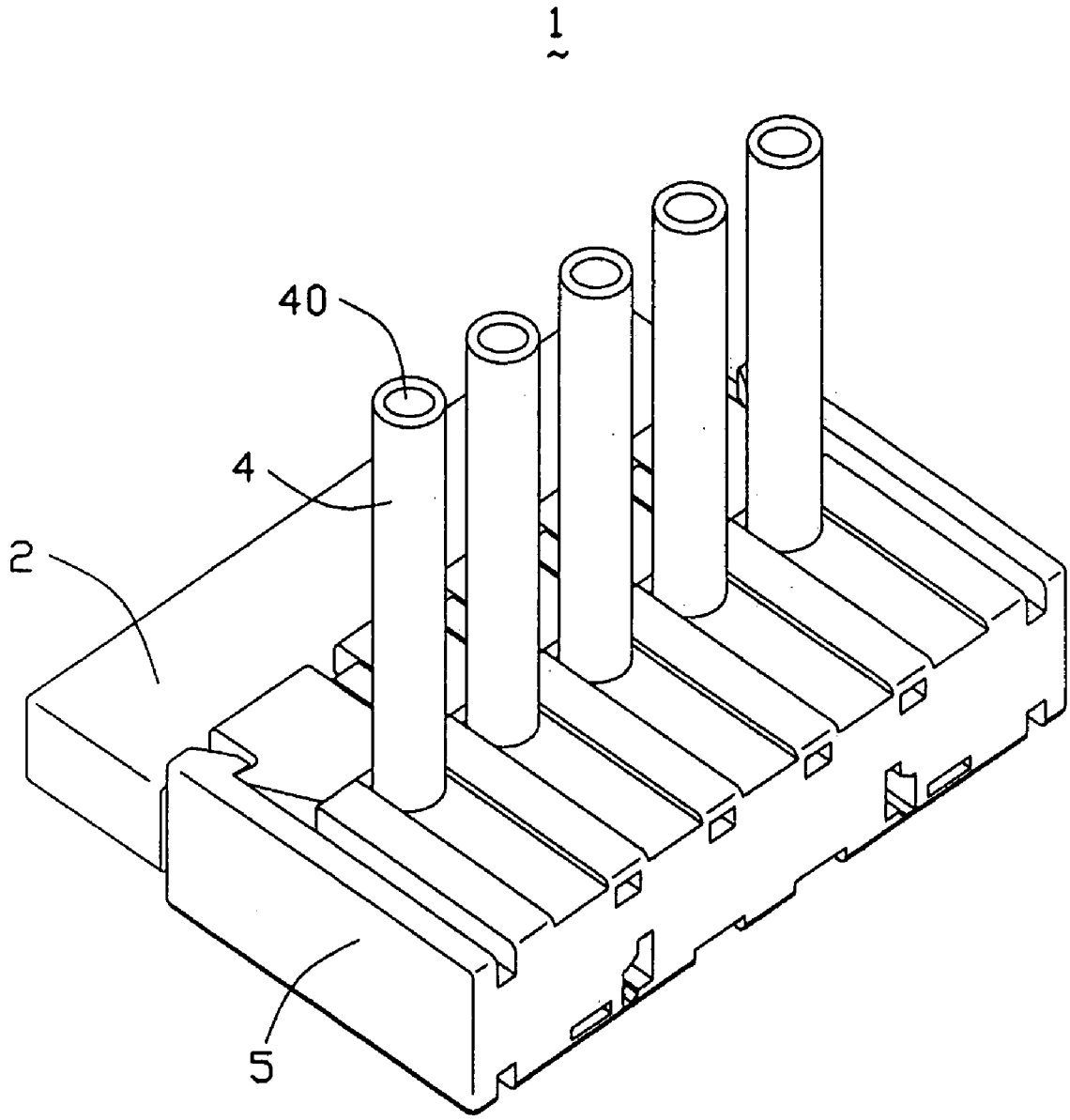
Figure 9:
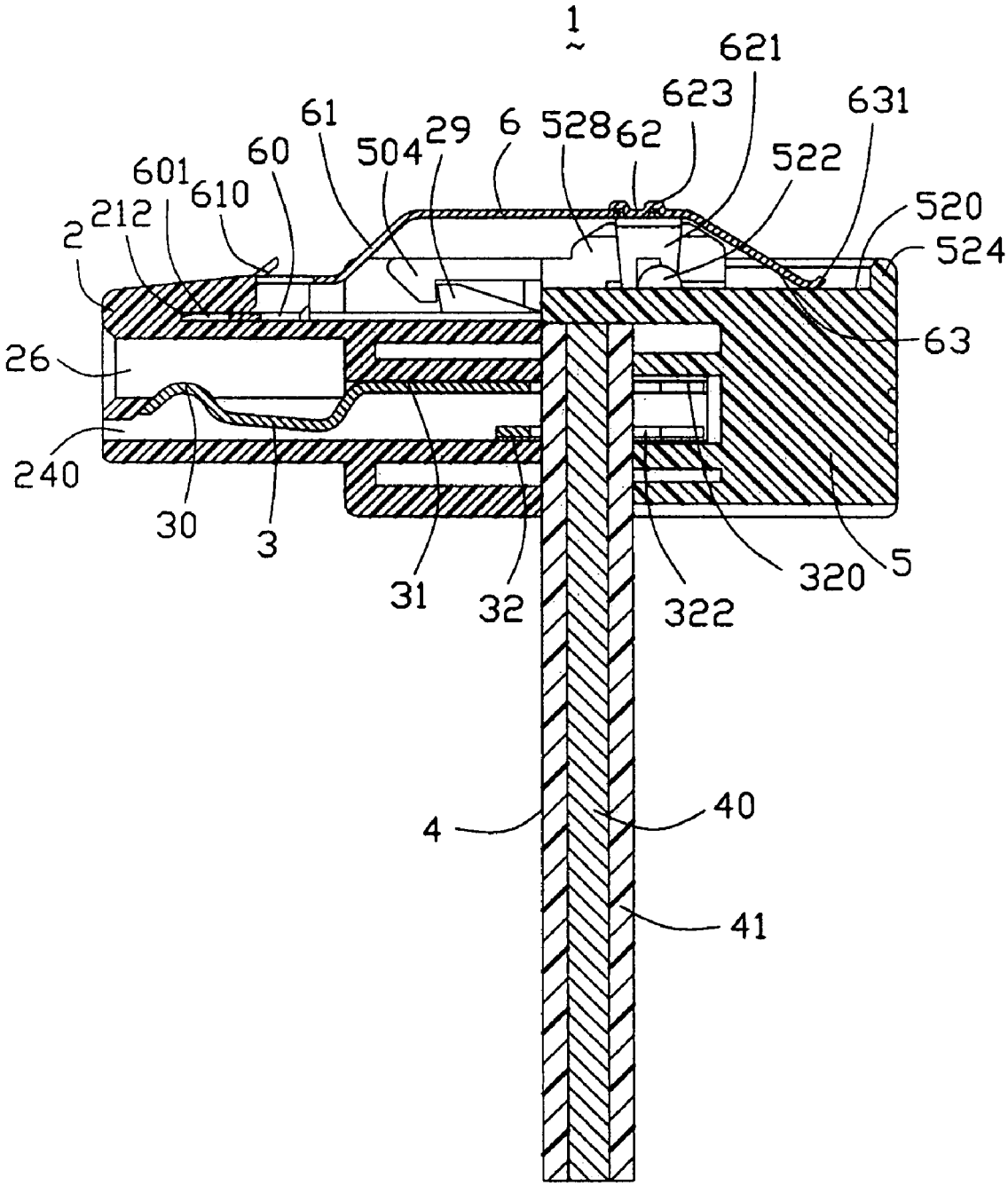
FIG. 9 is a cross-sectional view taken along lines 9—9 of FIG. 5.
Figure 10:
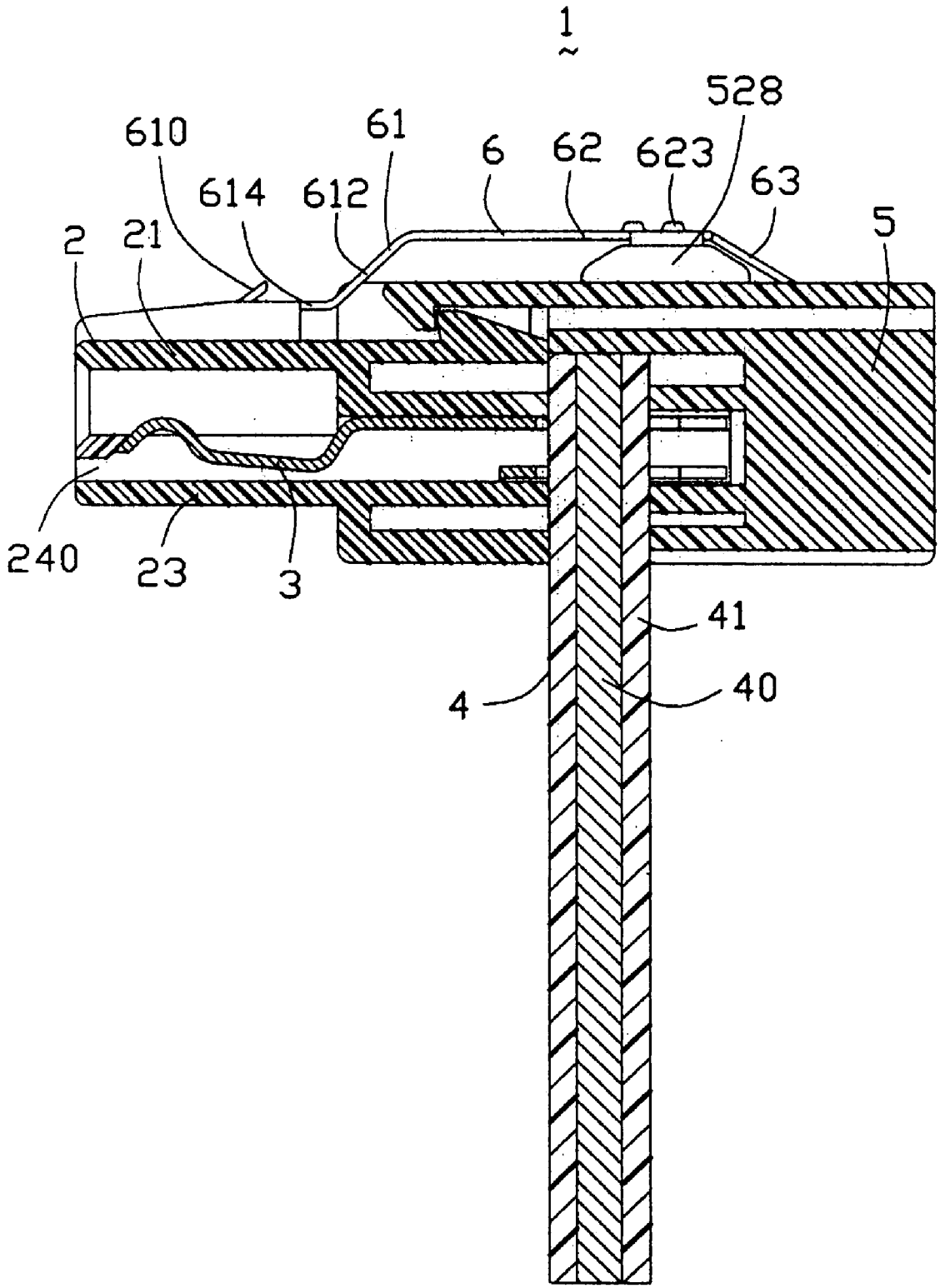
FIG. 10 is a cross-sectional view taken along lines 10—10 of FIG. 5.
Figure 11:
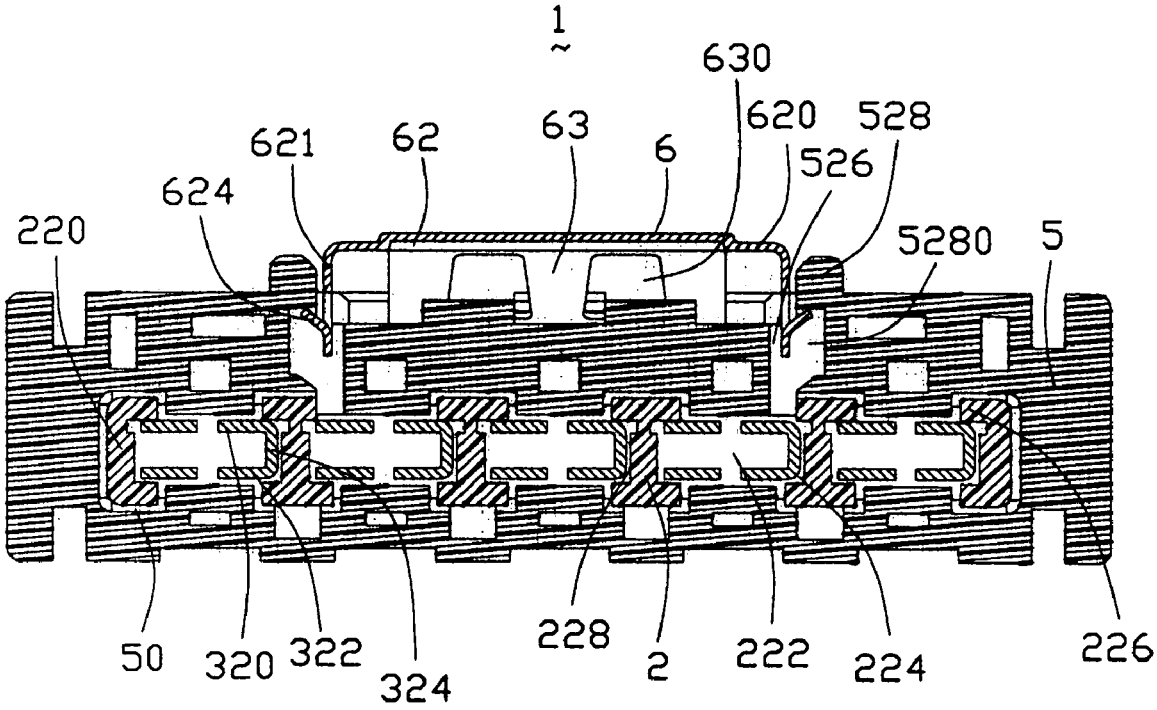
FIG. 11 is a cross-sectional view taken along line 11—11 of FIG. 7.
Figure 12:
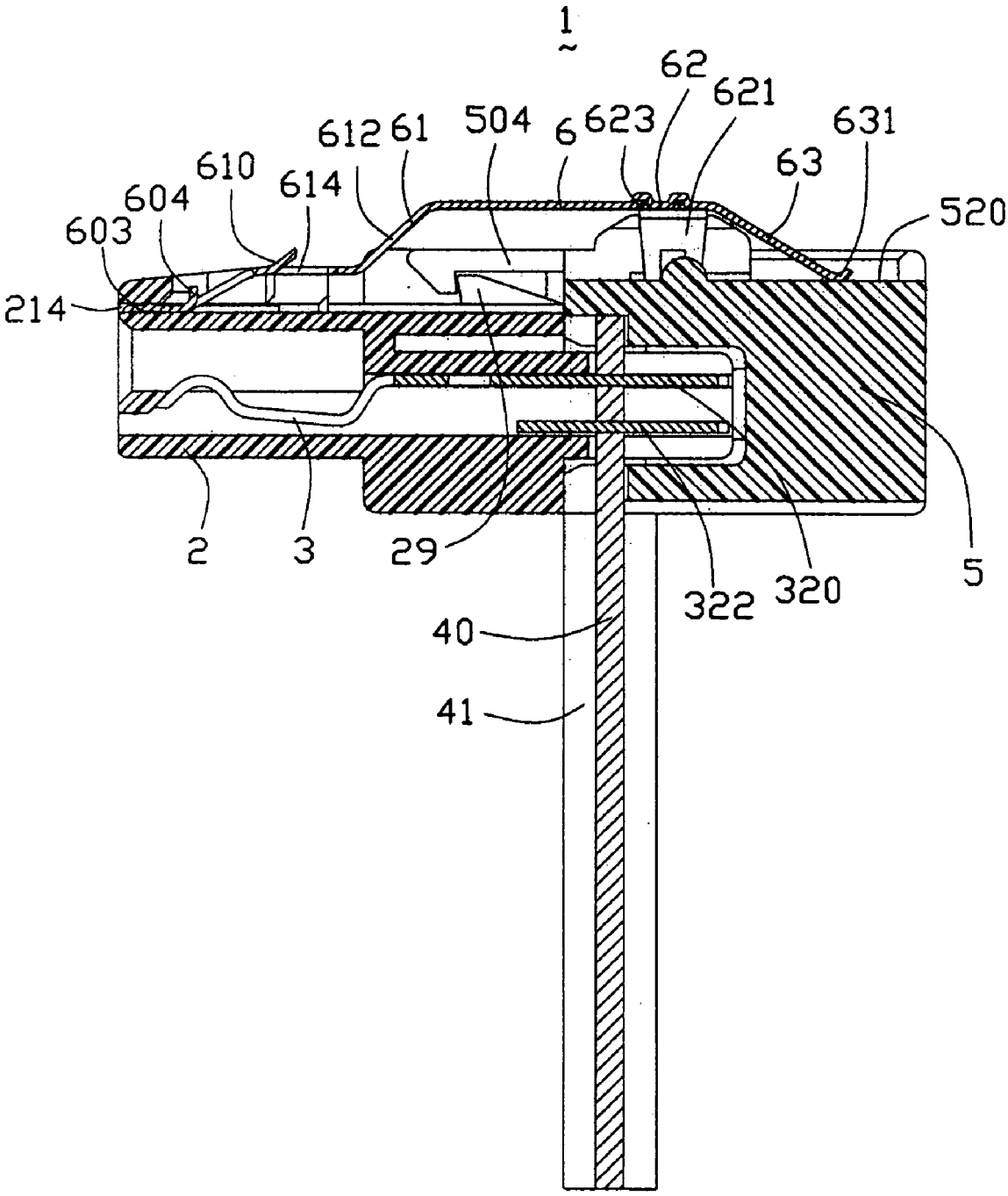
FIG. 12 is a cross-sectional view taken along line 12—12 of FIG. 5.
Figure 13:
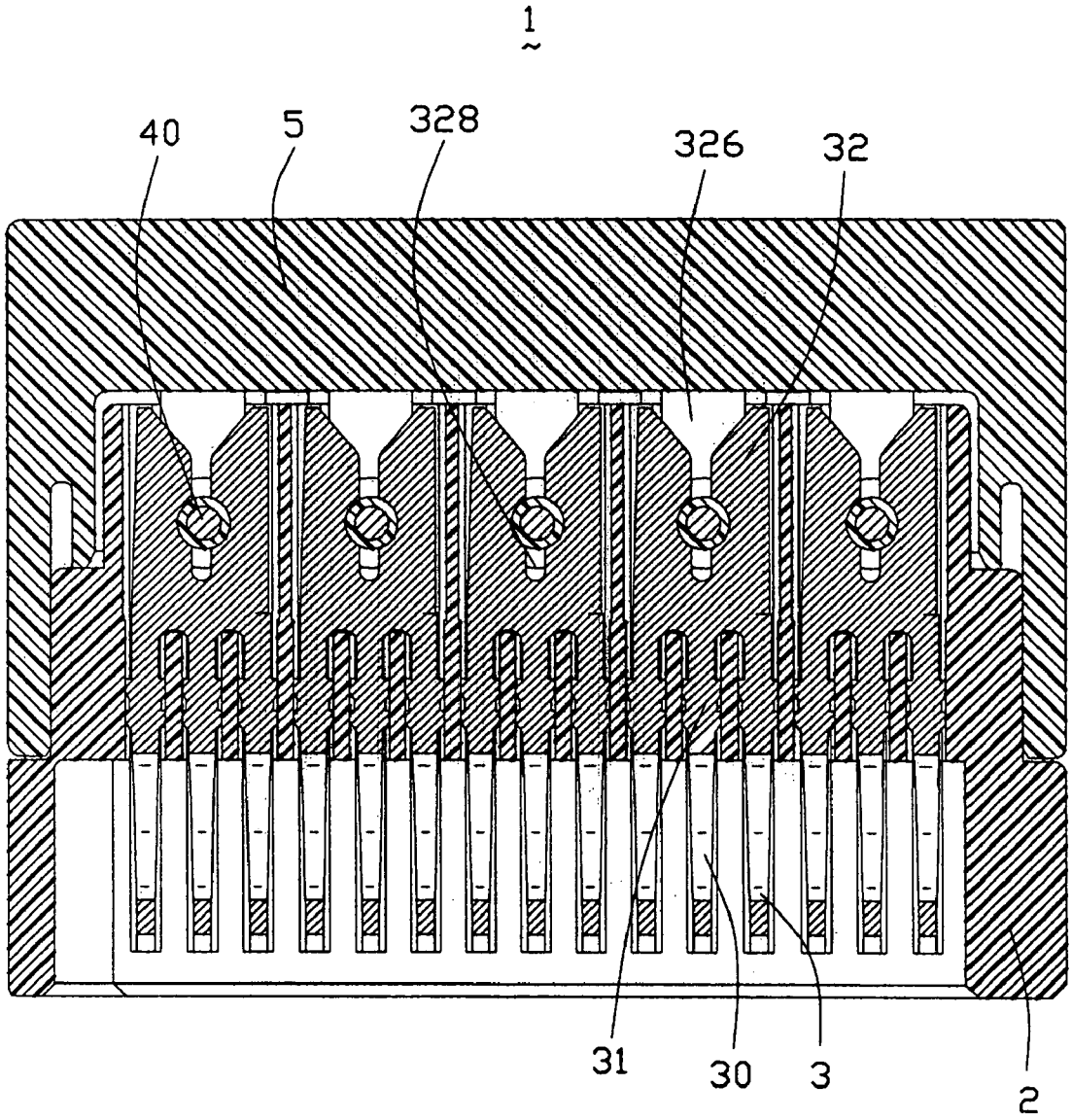
FIG. 13 is a cross-sectional view taken along lines 13—13 of FIG. 5.
Figure 14:
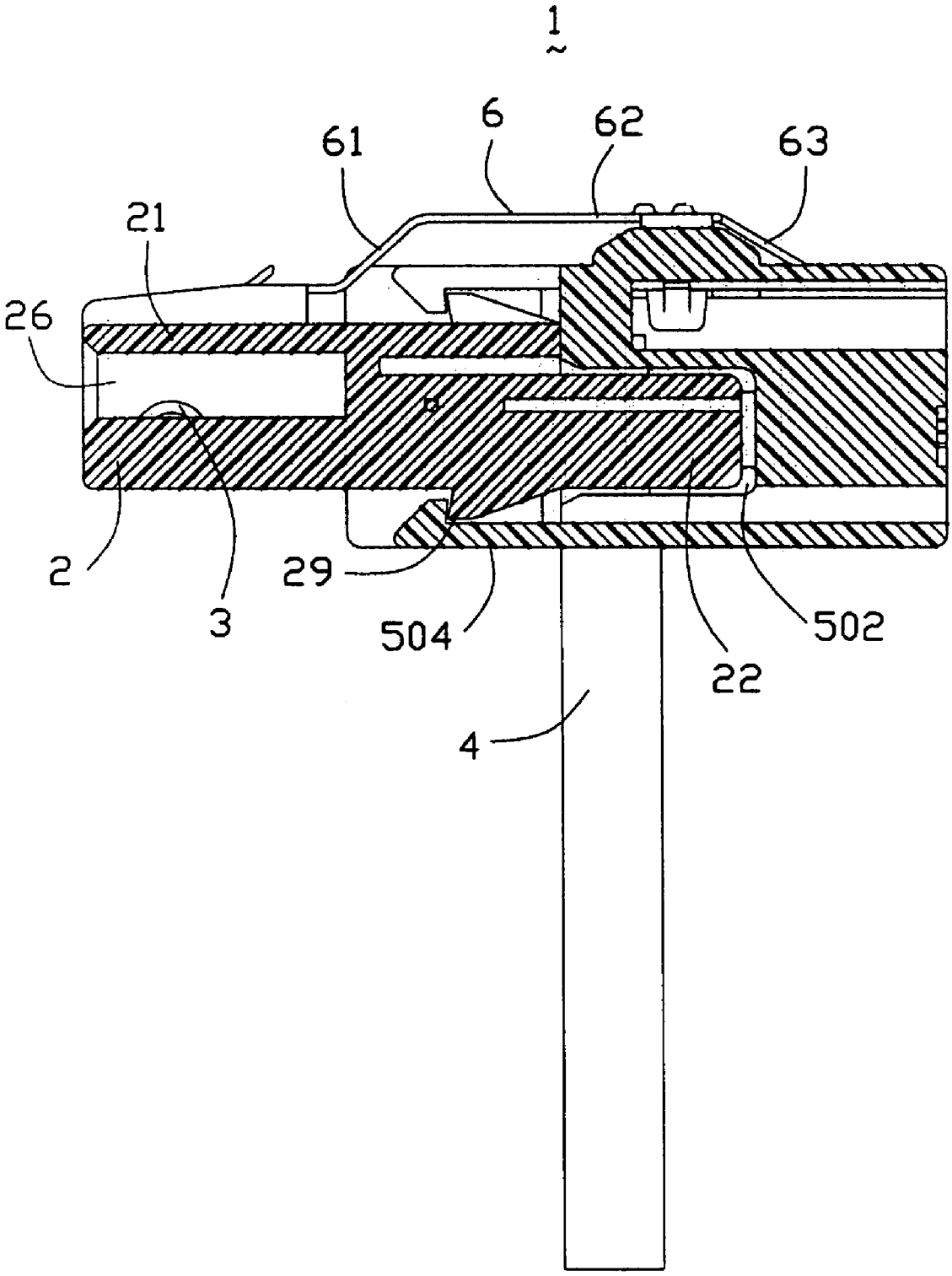
FIG. 14 is a cross-sectional view taken along lines 14—14 of FIG. 5.
Figure 15:
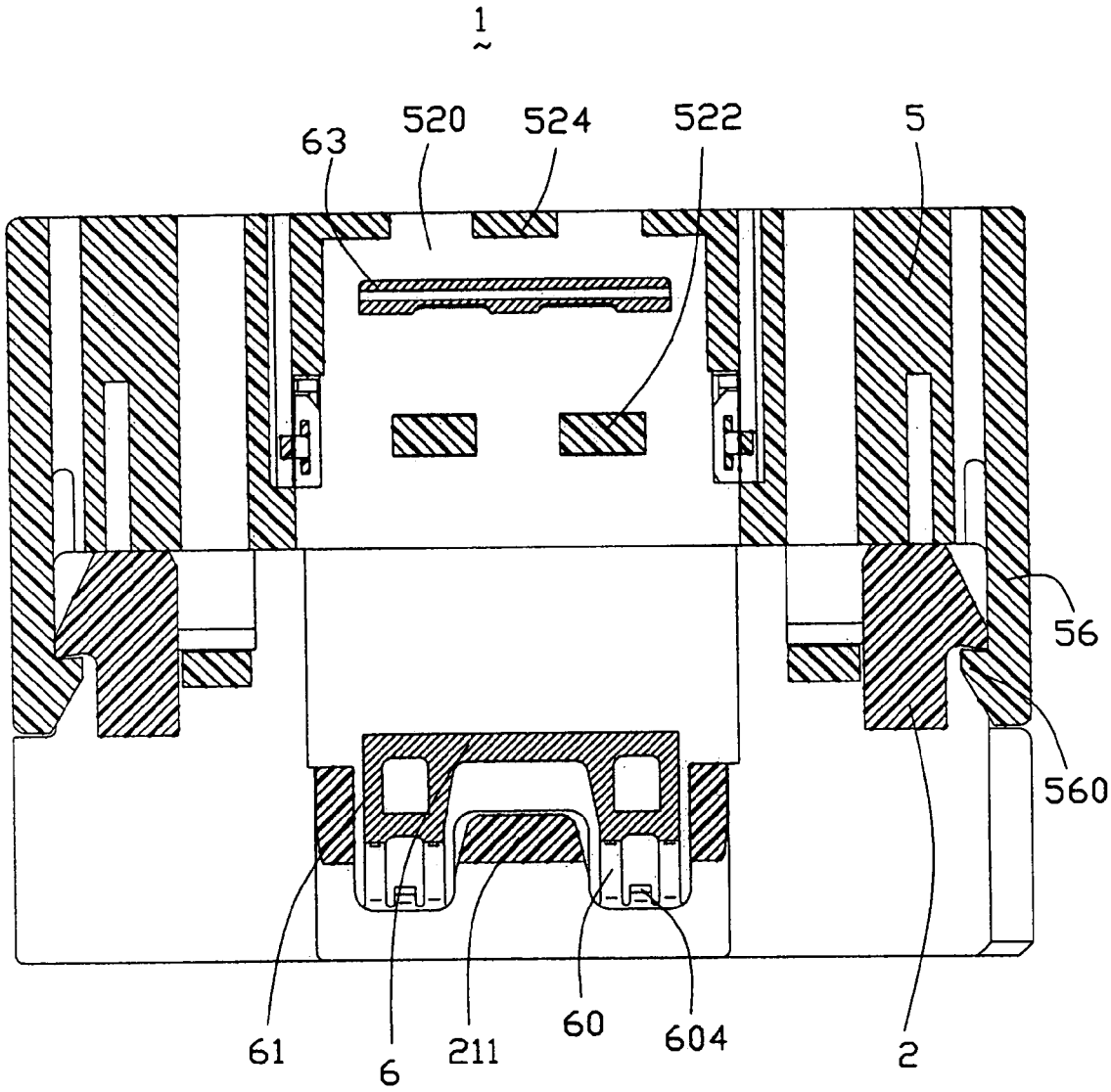
FIG. 15 is a cross-sectional view taken along lines 15—15 of FIG. 5.

Particularly referring to FIGS. 5 and 7 in conjunction with FIGS. 9–12 and 15, the locking member 6 is assembled to the insulative housing 2 and the cover 5. The pair of side beams 621 of the locking member 6 are respectively inserted into the passages 526 of the cover 5 with the spring tabs 624 received in the spaces 5280. The spring tabs 624 can slide in the spaces 5280 along the front-to-rear direction. The bar sections 602 are received in the grooves 213 of the insulative housing 2. The middle portion of the retaining portion 60 is received in the slit 212 with the positioning sections 603 and the snap sections 601 respectively locked with the first and the second slots 214, 215 to prevent the locking member 6 from moving rearwardly when the cable end connector assembly 1 mates with the complementary connector. The supporting portion 63 is located in the cutout 520 of the cover 5 with the curved edge 631 abuts against a bottom surface of the cutout 520. The spring tabs 624 of the pressing portion 62 elastically abut against bottom surfaces of the tubers 528 for preventing the locking member 6 from escaping the spaces 5280 of the housing 2. The pressing portion 62 is downwardly movable relative to the rear portion of the cover 5 to deflect the locking portion 61 toward the cover 5 and the insulative housing 2.

When the cable end connector assembly 1 is to be mated with the complementary connector, a downward pressing force is exerted on the pressing portion 62 of the locking member 6. The pressing portion 62 moves downwardly until the rear portion of the body section 620 contacts with the pivot portions 522 of the cover 5 and the locking portion 61 creates a vertical displacement toward the housing 2. The body section 620 then becomes curve toward the cover 5 under the pressing force with the locking portion 61 creating a further vertical displacement. Since the retaining portion 60 and the supporting portion 63 respectively engage with the cover 5 and the insulative housing 2 and thus, together form a girder. The vertical displacement of the locking portion 61, particularly the latch sections 610, is big enough to realize the lock between the cable end connector assembly 1 and the complementary connector easily. When the cable end connector assembly 1 is to be disengaged from the complementary connector, a contrary operating procedure is applied. Because of the relatively big displacement of the latch sections 610, the disengagement between the cable end connector assembly 1 and the complementary connector is also easy to realize.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly for mating with a complementary connector, comprising:

an insulative housing comprising a front engaging portion and a rear terminating portion;

a plurality of contacts received in the insulative housing, each contact comprising a mating portion, an insulation displacement portion opposite to the mating portion and a retention portion interconnecting the mating portion and the insulation displacement portion;

a plurality of wires terminated to the insulation displacement portions of corresponding contacts;

a cover latchably mounted to the terminating portion of the insulative housing and compressing the wires into reliable electrical connection with the insulation displacement portions of the contacts, the cover defining a pair of passages in an up-to-down direction thereof; and a locking member comprising at a front end thereof a retaining portion secured with the engaging portion of the insulative housing, a supporting portion at a rear end thereof engaged with the cover, a pressing portion close to the supporting portion and movably received in the pair of passages of the cover, and at least one latch section located on the front end thereof close to the retaining portion and adapted for locking with the complementary connector, the pressing portion being movable along said up-to-down direction toward the cover under a pressing force.

2. The cable end connector assembly as claimed in claim 1, wherein the terminating portion of the insulative housing comprises a plurality of posts extending rearwardly from the engaging portion, every two neighboring posts defining a contact-receiving tunnel, and wherein the insulation displacement portions of the contacts are respectively received in the contact-receiving tunnels.

3. The cable end connector assembly as claimed in claim 2, wherein the cover defines a plurality of receiving cavities recessing rearwardly from a front surface thereof, and wherein the posts of the insulative housing and the insulation displacement portions of the contacts are respectively received in corresponding receiving cavities.

4. The cable end connector assembly as claimed in claim 2, wherein the insulation displacement of the contact comprises a first wall, a second wall and an intermediate section abutting against a side surface of the post, and wherein the first and the second walls each define a slot aligning with each other to receive the wire.

5. The cable end connector assembly as claimed in claim 3, wherein the insulative housing forms a plurality of hook portions on a rear portion of the engaging portion, and wherein the cover forms a plurality of latching arms extending forwardly from the front surface thereof to respectively snap onto the hook portions.

6. The cable end connector assembly as claimed in claim 1, wherein the pressing portion of the locking member comprises a body section and a pair of side beams extending vertically from the body section, and wherein the side beams of the locking member are respectively received in the passages of the cover and are allowed a restricted up and down movement in the passages.

7. The cable end connector assembly as claimed in claim 6, wherein the cover further defines a pair of spaces communicating with the passages, and wherein each side beam forms a spring tab engaged in the space for preventing the pressing portion from escaping from the passage.

8. The cable end connector assembly as claimed in claim 6, wherein the cover forms a pivot portion between the pair of passages, and wherein the body section of the pressing portion moves toward the cover until contacting the pivot portion under the pressing force.

9. The cable end connector assembly as claimed in claim 1, wherein the cover defines a cutout at a rear end thereof, and wherein the supporting portion is located in the cutout.

10. The cable end connector assembly as claimed in claim 9, wherein the supporting portion extends downwardly and rearwardly from the body section of the pressing portion, and wherein the supporting portion forms a curved edge at a free end thereof and pressing on a bottom surface of the cutout of the cover.

11. The cable end connector assembly as claimed in claim 1, wherein the locking member comprises a locking portion formed between the retaining portion and the pressing portion and including a first section extending rearwardly from the retaining portion and a second section formed between the first section and the pressing portion, and wherein the at least one latch section is formed on the first section.

12. The cable end connector assembly as claimed in claim 11, wherein the second section extends upwardly and rearwardly from the first section and connects with the pressing portion.

13. The cable end connector assembly as claimed in claim 1, wherein the insulative housing defines a slit receiving a middle portion of the retaining portion of the locking member.

14. The cable end connector assembly as claimed in claim 13, wherein the insulative housing defines a first slot communicating with the slit, and wherein the locking member forms a positioning section extending forwardly from the middle portion of the retaining portion and being locked within the first slot.

15. The cable end connector assembly as claimed in claim 13, wherein the insulative housing defines a second slot communicating with the slit, and wherein the locking member comprises a snap section extending rearwardly from the middle portion of the retaining portion and being locked within the second slot.

16. The cable end connector assembly as claimed in claim 1, wherein the body section of the pressing portion is formed with a plurality of ribs.

17. A cable end connector assembly comprising:

an insulative housing defining a front mating port and a rear termination portion;

a plurality of contacts disposed in the housing, each of said contacts defining a mating portion located in the mating port and an insulation displacement contact portion around the termination portion;

a cover latchably mounted to the termination portion;

a plurality of wires sandwiched between said housing and said cover, each of said wires mechanically and electrically connected to the corresponding contact via the corresponding insulation displacement contact portion piercing thereinto; and a deflectable locking member including a retention portion fixed to the housing, a supporting portion seated upon the cover and moveable along a front-to-back direction when said locking member is depressed, and a latch section located between said retention portion and said supporting portion and moveable in a vertical direction perpendicular to said front-to-back direction when said locking member is depressed.

18. The assembly as claimed in claim 17, wherein said locking member further includes a tab on a side beam moveable in said vertical direction and engageable with the cover for preventing excessive movement of the locking member in said lateral direction.

19. A cable end connector assembly comprising:

an insulative housing defining a front mating port and a rear termination portion;

a plurality of contacts disposed in the housing, each of said contacts defining a mating portion located in the mating port and an insulation displacement contact portion around the termination portion;

a cover latchably mounted to the termination portion;

a plurality of wires sandwiched between said housing and said cover, each of said wires mechanically and electrically connected to the corresponding contact via the corresponding insulation displacement contact portion piercing thereinto; and a locking member including a retention portion fixed to one of the housing and the cover, a supporting portion opposite to said retention portion and seated upon the other of the housing and the cover and moveable along a front-to-back direction when said locking member is depressed, and a latch section located between said retention portion and said supporting portion and moveable in a vertical direction perpendicular to said front-to-back direction when said locking member is depressed.

20. The assembly as claimed in claim 19, wherein said locking member further includes a tab on a side beam moveable in said lateral direction and engageable with said other of the housing and the cover for preventing excessive movement of the locking member in said vertical direction.

* * * * *